United States Patent [19]

Taylor et al.

[11] Patent Number: 4,536,889

[45] Date of Patent: Aug. 27, 1985

[54] FACE AND NOSE WIPER HOLDING DEVICE FOR SKIERS

[75] Inventors: Kevin D. Taylor, Ogden; Galen N. Nichols, Salt Lake City, both of Utah

[73] Assignee: TNF Enterprises, Salt Lake City, Utah

[21] Appl. No.: 587,664

[22] Filed: Mar. 8, 1984

[51] Int. Cl.[3] ..... A41D 19/00

[52] U.S. Cl. ..... 2/160; 2/250; 206/233

[58] Field of Search ..... 2/160, 161 R, 161 A, 2/162, 170, 159, 249, 250, 251, 252, DIG. 6, DIG. 11; 206/233

[56] References Cited

U.S. PATENT DOCUMENTS

| | | | |
|---|---|---|---|
| 1,426,797 | 8/1922 | Wangelin | 2/160 |
| 2,103,711 | 12/1937 | Cole | 2/160 |
| 2,537,701 | 1/1951 | Previdi | 2/250 X |
| 3,185,197 | 5/1965 | Spiro et al. | 2/DIG. 6 |
| 3,537,108 | 11/1970 | Daniels | 2/252 |
| 4,185,753 | 1/1980 | Leto | 206/233 X |
| 4,244,057 | 1/1981 | Burnham | 2/160 |
| 4,387,838 | 6/1983 | Jackson | 2/160 X |

*Primary Examiner*—Henry S. Jaudon
*Assistant Examiner*—J. L. Kravitz
*Attorney, Agent, or Firm*—A. Ray Osburn

[57] ABSTRACT

A face and nose wiper holder for skiers, adapted for attachment to the lower arm of the skier and having a retractable cover exposing the wiper for use by the skier without removal from the holder. The holder is adapted for use of facial tissue sheet wipers or of pre-packaged absorbent pad wipers. According to another aspect of the invention, the wiper holder may be adapted for use upon the wrist of one of the skier's gloves.

10 Claims, 8 Drawing Figures

FACE AND NOSE WIPER HOLDING DEVICE FOR SKIERS

BACKGROUND OF THE INVENTION

1. Field

The field of the invention is devices for the holding and carrying of face and nose wipers by skiers, and more particularly such devices that permit the use of the wipers without holding them by the fingers, so that the hands may be generally otherwise occupied.

2. State of the Art

Nose drip is a very frequent accompaniment to the cold weather outdoor activity of skiing. This requires frequent wiping of the nose and/or face by facial tissues or the like. Heretofore, a skier with irritating nose drip has generally found it necessary to stop, disengage at least one pole and one ski glove, retrieve tissues, handkerchief or the like from a pocket, use it and return it to the pocket for later disposal. This troublesome sequence often leads skiers, especially children, to use such wiping expedients as the sleeves of their jackets, to avoid such trouble, bother, interruption and delay. This solution is generally unattractive to older skiers, and also to the parents of said children. Often, rather than interrupt the ski run, the skier endures the irritation of the nose drip until the run is over, a solution which can take a considerable amount of enjoyment out of recreational skiing.

The prior art does not, to the knowledge of the inventor, contain any device to aid in this problem of skier nose drip.

BRIEF SUMMARY OF THE INVENTION

With the foregoing in mind, the disadvantages of the prior art are eliminated or substantially alleviated by providing a face and nose wiper holder adapted to be secured about the arm of the skier, the wiper being secured to the holder in position to permit the face and nose to be wiped without removal of the wiper from the holder. Releasable means are provided for securing the wiper within the holder, so that it may be removed when soiled by use and replaced with fresh. Preferably, the holder further comprises a wiper protective cover hinged for ready release to expose the surface of the wiper, which may then be used in place. The holder is adapted for the use of facial tissue sheets singly or stacked together, folded as necessary, the ends of the stack being clamped to the holder. Or, a pre-packaged absorbent pad may be used with the holder. In another embodiment, the holder is adapted for securement to the glove of the skier, this embodiment preferably using flexible material throughout. According to another aspect of the invention, the tissue holder may be integrated into the glove.

It is therefore a principal object of the invention to provide for the use of face and nose wipers with maximum facility by skiers with minimum interruption of the skiing activity. A further principal object is to provide a wiper holder which protects the wiper from moisture and the like when not in use and which also covers and conceals it both before and after use.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
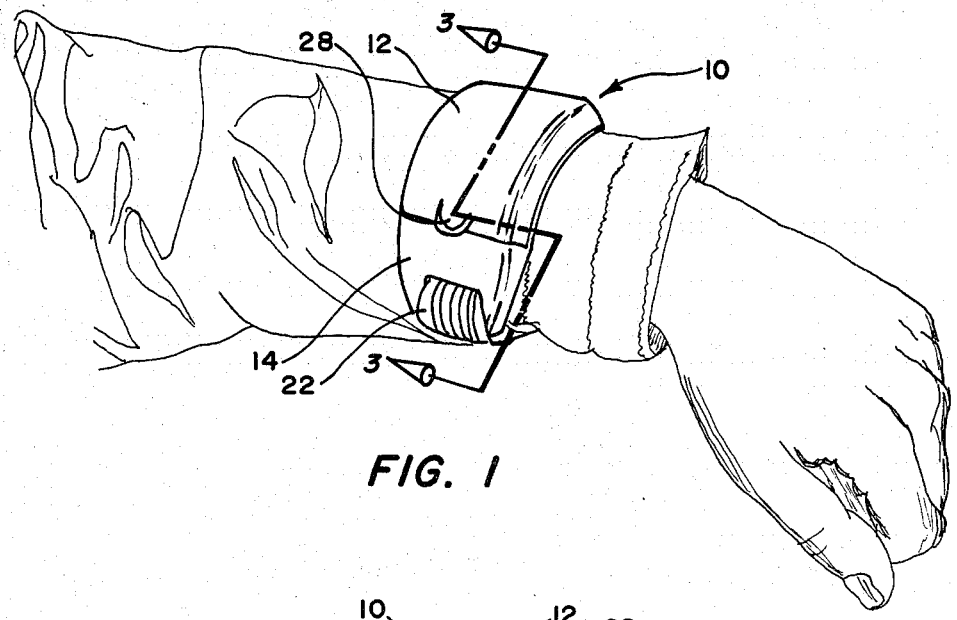
FIG. 1 is a view of the skier's face and nose wiper holder affixed to the lower arm of a skier, drawn to a somewhat reduced scale, FIG. 2 the wiper holder of FIG. 1, shown with the wiper cover being opened for subsequent use of the wiper therein by the skier, FIG. 3 an end view of the wiper holder of FIG. 1, partially sectioned along line 3—3 thereof, the cover however being shown in open position, drawn to substantially full scale, FIG. 4 a view of the wiper holder of FIG. 1, the cover and clamping members thereof being retracted away from the base member to permit the installation of the wiper on the base member thereof, drawn to a reduced scale, FIG. 5 a perspective view of a pre-packaged absorbent pad wiper for use in the holder of FIG. 1, drawn to substantially full scale, FIG. 6 a view of another embodiment of a face and nose wiper holder in accordance with the invention, shown in the opened position, drawn to substantially full scale, FIG. 7 a view of the wiper holder of FIG. 6, shown in partially closed position, the wiper cover however being open to expose a pre-packaged absorbent pad wiper for use by the skier, and FIG. 8 a view of another embodiment of a face and nose wiper holder in accordance with the invention, the holder in this embodiment being adapted for use upon the wrist of a glove of the skier, drawn to a somewhat reduced scale.
Figure 2:
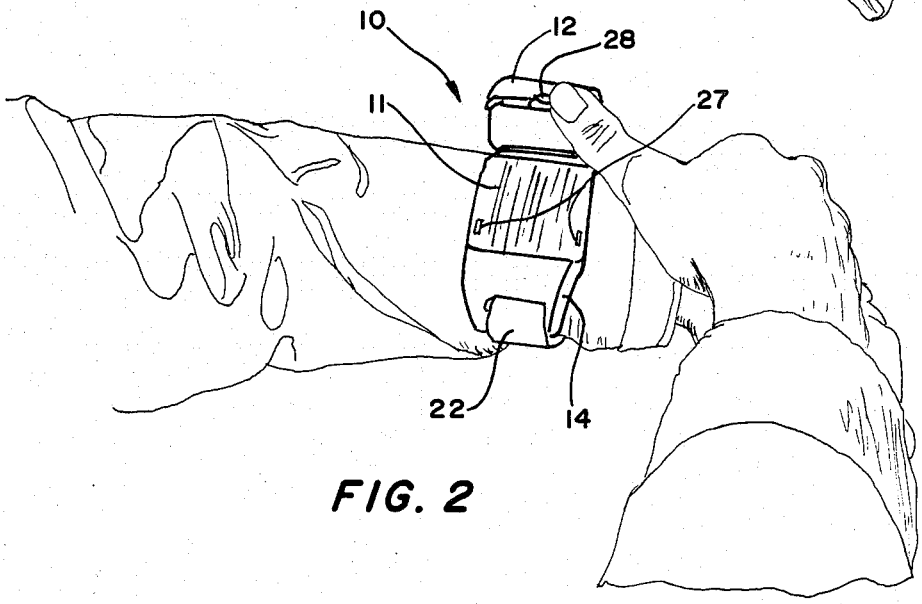
Figure 3:
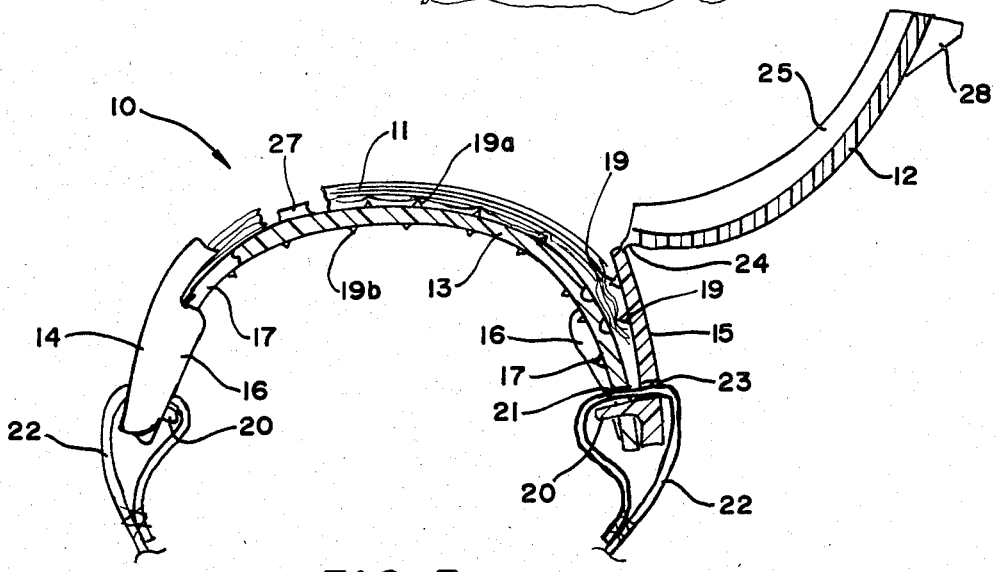

A closed face and nose wiper holder 10 is shown in FIG. 1 affixed to the lower arm of a skier. In FIG. 2, holder 10 is being opened for use, exposing wiper 11 beneath wiper cover 12, to be used, for instance, to wipe the nose of the skier without being removed from holder 10. Wiper 11 may be made up of one or more sheets of facial tissue, as seen in FIGS. 1-3, or a pre-packaged absorbent pad may be provided, as later described herein. As shown in detail in FIGS. 3 and 4, wiper holder 10 comprises a base member 13, advantageously curved to generally conform to the skier's sleeve at the point of attachment thereto. Wiper clamp members 14 and 15 secure the wiper tissue 11 upon base 13. Each clamp has downstanding sides 16 which elastically engage portions 17 of the sides of base 13. The tissue 11 is firmly engaged between the clamp members 14 and 15 and base 13 and more firmly by dimples 18 which may be provided in the top surface of base 13 along with matching downstanding protuberances 19 on clamps 14 and 15. Small protuberances 19*a* on the upper surface of base 13 also help to stabilize the wiper 11. Similar protuberances 19*b* extending downwardly from base 13 help to stabilize holder 10 upon the sleeve of the skier.

Figure 4:
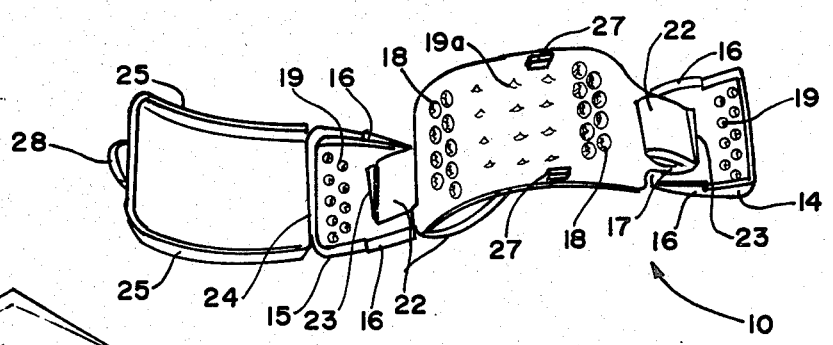

Each clamp 14 and 15 advantageously may have a tab 20 extending through a strap slot 21 in base 13, preventing the clamps from sliding off the ends of base 13. Strap 22, installed through the slot 21, and through slots 23 in clamps 14 and 15 secures the holder to the lower arm of the skier. Strap 22 may be an unbroken continuous elastic member or may comprise two members joined by a buckle, matching strips of hook and loop material sugh as VELCRO or the like, not shown. Strap 22 is preferably looped as in FIG. 3 through both the slots 21 and 23, thus serving to secure holder 10 together when the clamps 14 and 15 are disengaged for installation of a wiper 11, as seen in FIG. 4. Wiper cover 12 is connected to clamp 15 preferably by a narrow flexible band 24, commonly referred to as a "live" hinge, preferably molded integrally with cover 12 and clamp 15. Cover 12 is curved to correspond to base 13, downwardly extending sides 25 resting upon upper surface 26 of base 13 about the tissue wiper 11 under cover 12. Latching tabs 27 extend upward from base 13 and are elastically engaged by sides 25 of cover 12. A lifting tab 28 may be provided to facilitate the opening of cover 12.

Preferably, base 13, clamps 14 and 15 and cover 12 are of rigid molded plastic. One very suitable material is a polypropylene of medium hardness, having the excellent bending fatigue resistance required by "live" hinge 24. Other materials, plastic or otherwise, may be satisfactory, and minor design changes to accommodate such materials are within the spirit of the invention. For example, "live" hinge 24 could be replaced by a conventional hinge.

Figure 5:
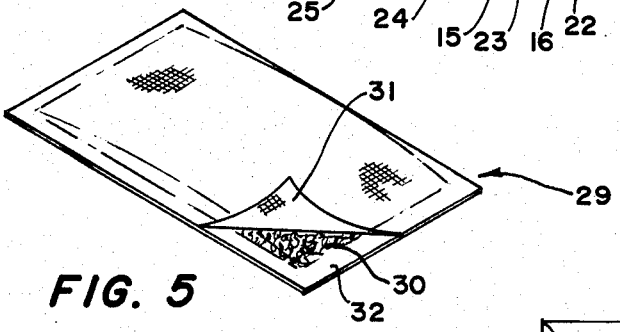

Wiper holder 10 is used most often in dealing with the nose drip commonly afflicting the skier, who may open cover 12 to directly apply the exposed tissue wiper 11 to his nose. Subsequently, cover 12 may be closed, protecting the tissue wiper 11 but also concealing the soiled wiper from sight until it can later be discarded and replaced. Wiper 11 may be provided in the form of a stack of individual sheets of tissue as in FIG. 3, or as a pre-packaged flexible absorbent pad wiper 29 seen in FIG. 5. Absorbent wadding 30 is enclosed by upper and lower porous sheets 31 and 32 such as commonly used in diapers and called "stay-dry." The "stay-dry" liner adds to both the esthetics and the utility of the wiper 11. Absorbent pad wiper 29 is of proper dimensions to be clamped into holder 10 in the manner previously described for wiper tissue 11.

Figure 6:
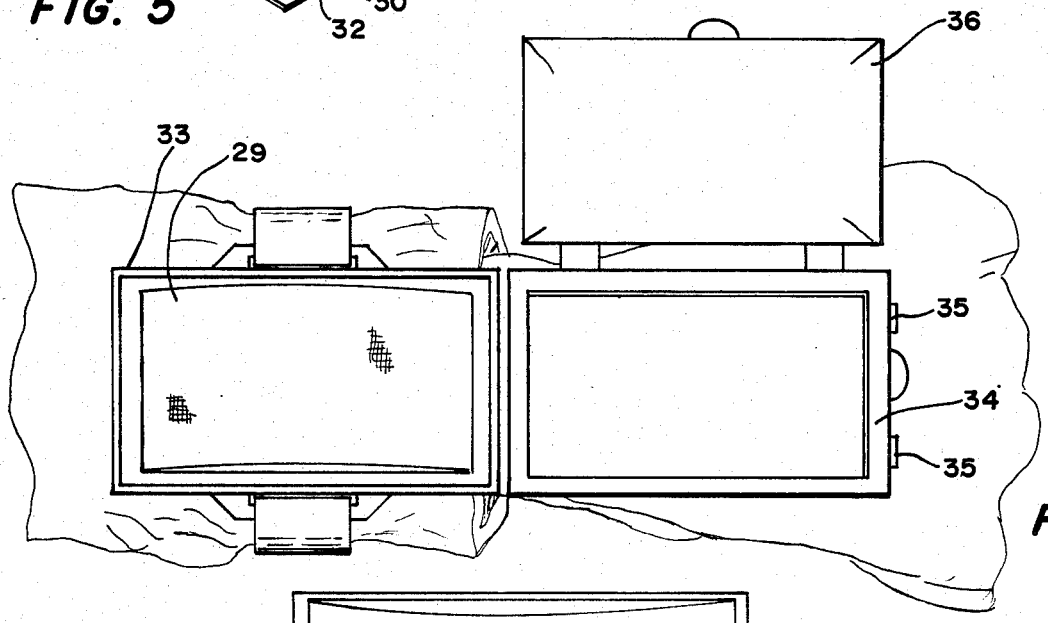
Figure 7:
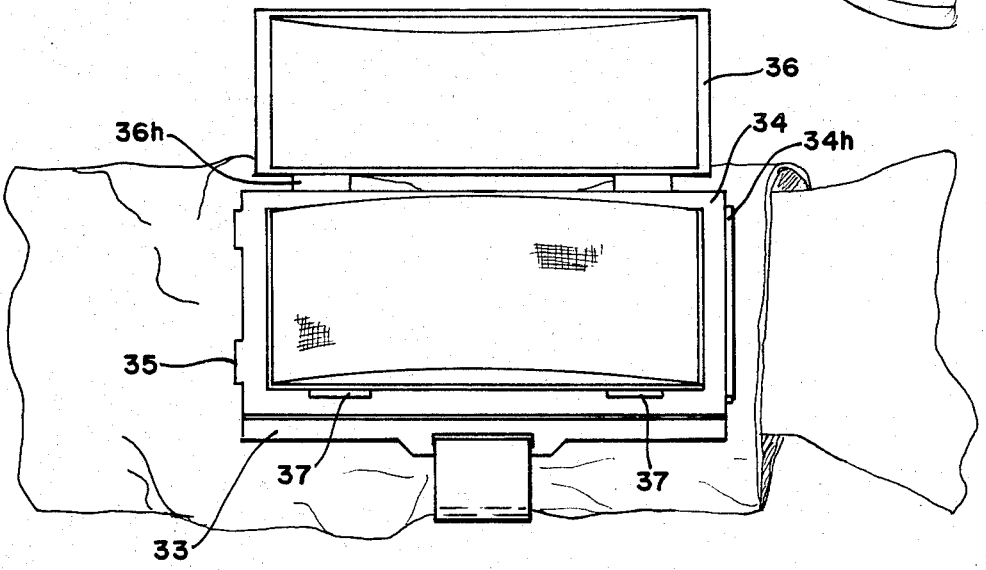

Another embodiment of wiper holder 10 is indicated in FIGS. 6 and 7, also adapted for the absorbent pad wiper 29. In this embodiment, absorbent pad wiper 29 is held upon a base 33 by an apertured frame 34 which engages pad 29 about its periphery and has frame latching tabs 35 for engaging base 33, to which it is "live" hinged. A cover 36, "live" hinged to frame 34 engages cover latching tabs 37 thereon, and is concavely contoured to provide clearance for absorbent pad wiper 29.

Figure 8:
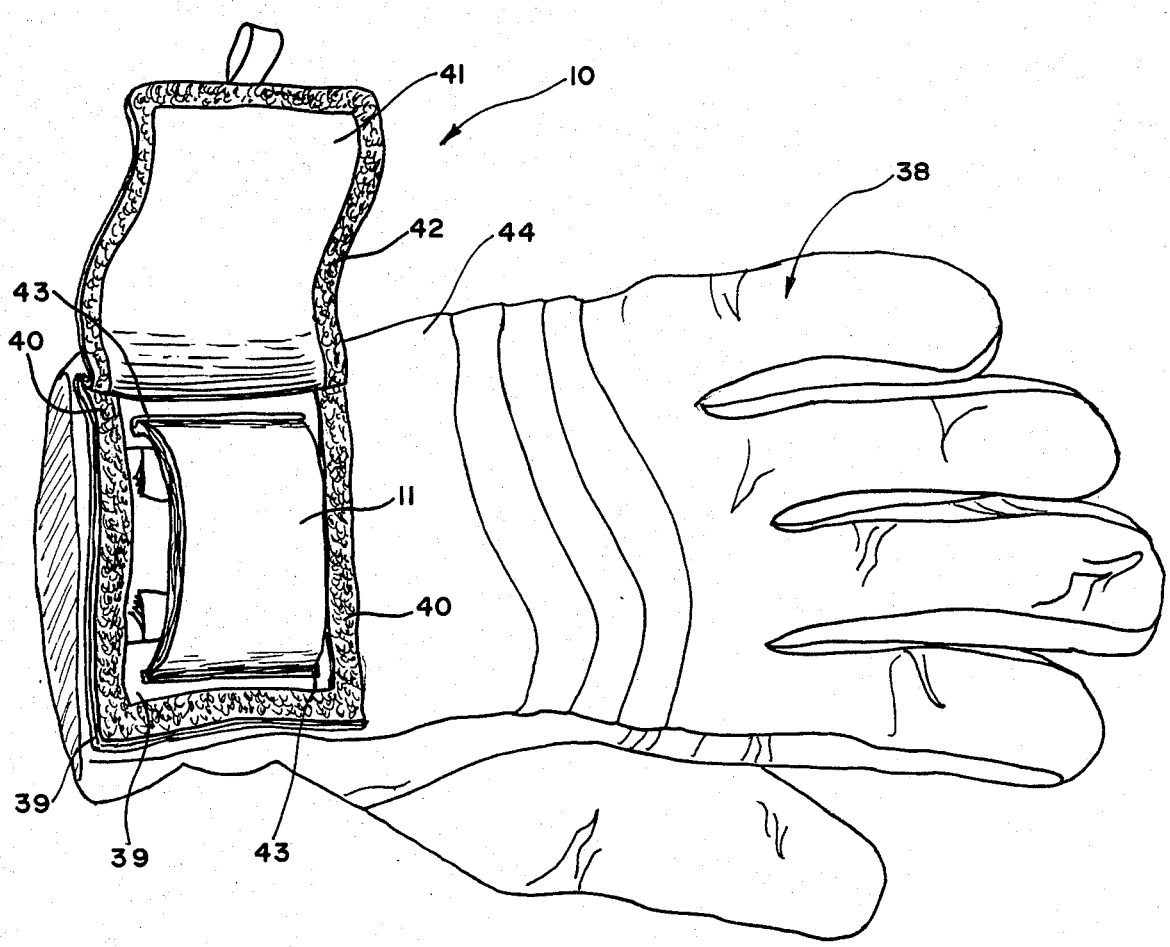

The wiper holder 10 may be adapted for securement to a skier's glove 38. (FIG. 8) In this embodiment, a flexible base sheet 39 has an upwardly facing VELCRO hook border strip 40, and a flexible cover sheet 41 attached along one of its edges and having a matching, downward facing VELCRO loop border 42. Clamp means, such as slots 43, secure wiper 11 to base sheet 39. This version of wiper holder 10 is secured, as by stitching, gluing or the like to glove 38. According to one variation, the outer skin 44 of glove 38 could serve as the base sheet, replacing illustrated base sheet 39, and having, for example, slots 43 therethrough for attaching wiper 11. This glove version of wiper holder 10 may also be adapted to utilize absorbent pad wiper 29. A similar version of wiper holder 10 could be adapted for securement to the sleeves of the skier's jacket, or for integration therewith.

The invention may therefore be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced herein.

What is claimed and desired to be secured by United States Letters Patent is:

1. A holder for face and nose wiper means, comprising:

means for securing the holder to an upper limb of a skier;

generally rigid base member means;

means for securing the wiper means to the holder comprising clamping means for securing the wiper means to the base member means;

generally rigid wiper covering means covering the wiper means when not being used and retractable with respect to the base member means to expose the wiper means for use.

2. The holder of claim 1, wherein:

the wiper clamping means comprise a pair of clamping members at opposite ends of the rigid base member means; and the wiper cover means is hinged to one of the clamping members.

3. The holder of claim 2, wherein:

each clamping member includes a wiper means gripping portion and a pair of downstanding portions at opposite sides thereof, said pair of downstanding portions each being adapted to elastically grip the sides of the associated end of the base member means therebetween, so that each end of the wiper means is held between the gripping portion of the clamping member and the base member means.

4. The holder of claim 2, wherein:

the means for securing the holder to the limb of the skier comprises strap means connecting the opposite ends of the base member means.

5. The holder of claim 4, wherein:

the base member means includes a strap engaging transverse slot at each of its ends.

6. The holder of claim 5, wherein:

each wiper clamping member includes a strap engaging transverse slot indexed with the slot of the base member means, so that the clamping members and the base member means may be held together by the strap means.

7. The holder of claim 6, wherein:

the face and nose wiping means comprises facial tissue in sheet form.

8. The holder of claim 6, wherein:

the face and nose wiping means comprises a pre-packaged absorbent pad.

9. A holder for face and nose wiping means, comprising:

a generally rigid base member adapted to be secured to an upper limb of a skier;

a generally rigid, open centered frame member for holding the face wiping means around its periphery to the base member, said frame member being hingedly connected to the base member;

means for releasably latching the frame member to the base member; and a wiper covering member hingedly connected to the frame member and releasably securable thereto in wiper covering position.

10. The holder of claim 9, wherein:

the face and nose wiping means comprises a pre-packaged absorbent pad.

* * * * *